United States Patent [19]

Wightman

[11] Patent Number: 4,472,894

[45] Date of Patent: Sep. 25, 1984

[54] PUNCHBOARD CALENDAR

[76] Inventor: Tony Wightman, 3497 Walters Dinos Ct., Hayward, Calif. 94542

[21] Appl. No.: 513,058

[22] Filed: Jul. 12, 1983

Related U.S. Application Data

[63] Continuation of Ser. No. 349,325, Feb. 16, 1982, abandoned.

[51] Int. Cl.[3] ..... G09D 3/00

[52] U.S. Cl. ..... 40/107; 40/110; 273/139

[58] Field of Search ..... 40/110, 107; 273/136

[56] References Cited

U.S. PATENT DOCUMENTS

| | | | |
|---|---|---|---|
| 780,086 | 1/1905 | Brewer et al. | 273/139 |
| 1,520,648 | 12/1924 | Holt | 40/107 |
| 2,301,970 | 11/1942 | Rau | 273/139 |
| 2,831,278 | 4/1958 | Myers | 40/107 |
| 2,914,871 | 12/1959 | Smith et al. | 40/107 |
| 3,290,812 | 12/1966 | Hunkins | 40/107 |

*Primary Examiner*—Gene Mancene
*Assistant Examiner*—Wenceslao J. Contreras
*Attorney, Agent, or Firm*—David Pressman

[57] ABSTRACT

A yearly calendar comprises a board (10) having an array of sections, one for each day of the year, each section having a hole (20) which contains a paper roll (24) printed with a message appropriate or useful for the respective day, such as a fortune, horoscope, riddle, anecdote, quotation, aphorism, etc. The paper rolls are retained by paper overlays (18, 22) on both sides of the board. A user of the calendar punches out each day's paper roll, perferably on the morning of such day. The paper rolls fall down a passageway (16) at the back of the board to a tray (34, 36) under the board, whereupon it is unrolled and read by such user. The punched-out sections of the board provide a useful graphic indication of elapsed days of the year.

5 Claims, 2 Drawing Figures

PUNCHBOARD CALENDAR

FIG. 1. PUNCHBOARD CALENDAR

SIDE SECTION OF FIGURE 1 IN OPERATION

PUNCHBOARD CALENDAR

This is a continuation of application Ser. No. 06/349,325, filed Feb. 16, 1982 now abandoned.

BACKGROUND—FIELD OF INVENTION

This invention relates to calendars, particularly to a calendar which is interesting to use and which provides amusement, education, etc.

BACKGROUND—DESCRIPTION OF PRIOR ART

Heretofore calendars existed in many forms; they were able to mark the elapsed days of the year by various mechanical or other means. While reliable and effective, these calendars were inherently prosaic and did not provide the user of the the calendar with any of the advantages or results other than the date indicating and marking functions. As is well known, most calendars are used in offices, homes, workshops, or other places of human activity and serve a mere background function except when called upon to indicate the date. It would be advantageous if a calendar were available to provide more interest or even excitement, in and of its own. The calendar would therefore occupy a more prominent place in the area in which it is displayed and a maker or seller of the calendar would have a substantial marketing advantage.

Accordingly, several objects of the invention are to provide a calendar which provides additional functions beyond that of date indication and marking, which is more saleable than other calendars, which can occupy a more prominent role in its place of use, and which provides amusement, education, diversion, etc. Further objects and advantages of the invention will become apparent from a consideration of the ensuing description thereof.

DRAWINGS

REFERENCE NUMERALS

Figure 1:
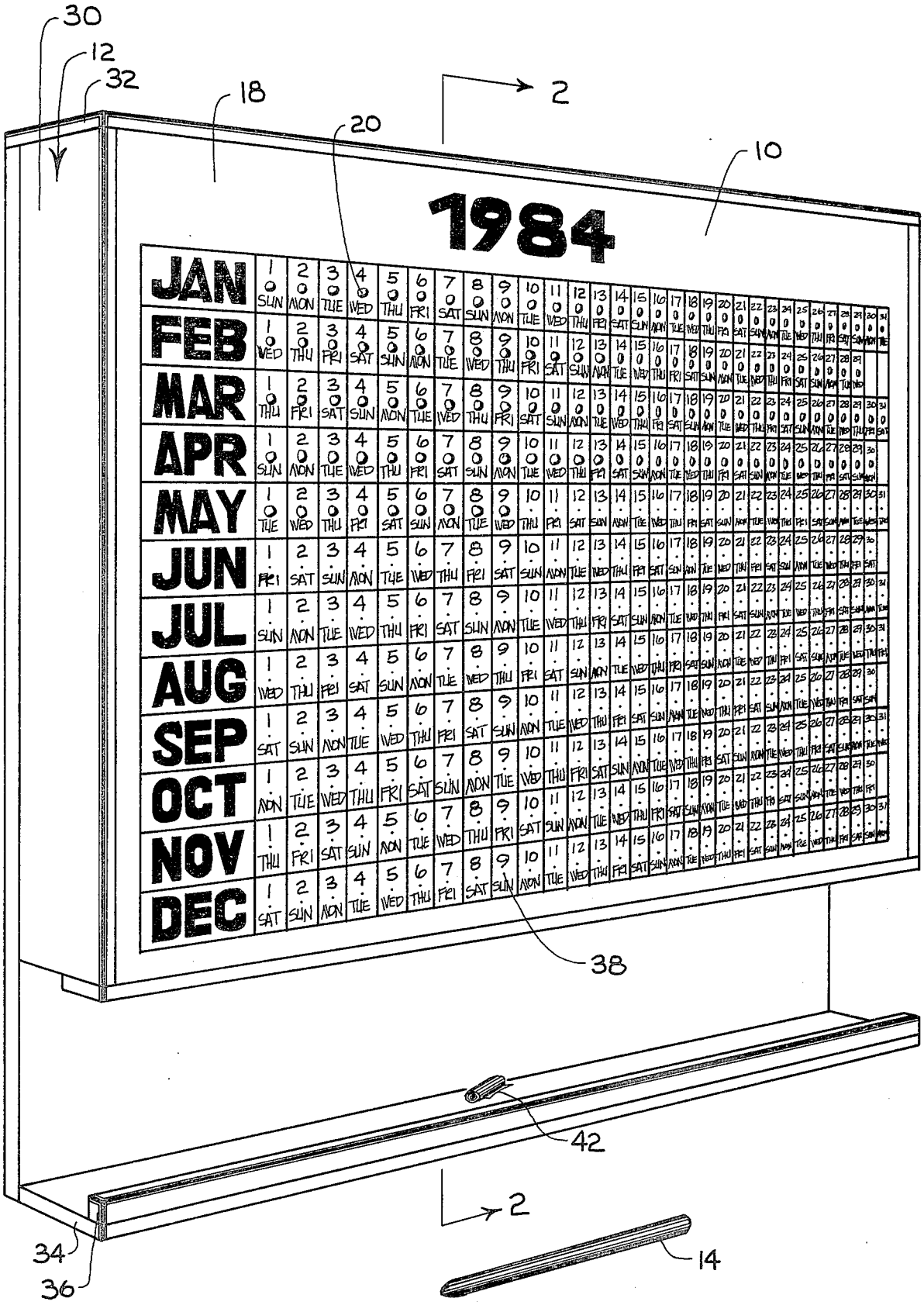
FIG. 1 is a perspective view of a calendar in accordance with the invention.

10 board
14 pusher
18 front overlay
rear overlay
26 backpiece of 12
34 horizontal member
38 dot target
12 frame assembly
16 chute
20 hole
24 paper roll
28, 30, 32 support members
36 lip
40 freed roll
42 unopened roll

FIGS. 1 AND 2—DESCRIPTION

A calendar according to the invention comprises a board 10 which is mounted in a frame assembly 12 and which is used with a pusher 14. Board 10 may be about 26 cm (10.5 in) high by about 35 cm (13.875 in) wide by about 2 cm (0.75 in) thick. Frame 12 may be about 4.5 cm (1.75 in) thick overall, with the rest of the dimensions being roughly proportional as indicated in the figures. A space 16 is provided between the back of board 10 and backpiece 26 of frame 12 and is about 2.5 cm (1 in) thick and provides a chute for purposes to be described subsequently.

The face of board 10 is covered with a paper overlay 18 which, as indicated, is imprinted with a calendar arranged in twelve rows, one for each month, with each row having a section for the respective days of the month. Behind each imprinted section on paper 18 a respective hole is drilled through board 10, a typical hole being indicated at 20. Such hole is about 0.5 cm (0.2 in) in diameter and extends completely through board 10 to the rear side thereof, said rear side also being covered by a paper or tissue overlay 22.

Within each hole (such as 20) is a coiled paper roll, such as 24, which, in its unrolled state, would measure about 1.75 cm (0.7 in) high by about 11.5 cm (4.5 in) long and which has a message printed thereon. The message may be about thirty words long and may be a fortune, daily aphorism, riddle (answer would be printed on reverse side of paper), joke, quotation, horoscope, etc. so as to provide diversion, amusement, education, entertainment, advice, inspiration, etc.

Frame 12 comprises a backpiece 26 to which are attached side and top support members, such as 28, 30, and 32, which hold board 10 spaced from, in front of, and parallel to backpiece 26. Attached to the bottom of backpiece 26 is a forwardly-extending horizontal member 34 having an upwardly-extending small lip 36 so as to provide a tray or trough at the bottom of the calendar.

The entire calendar assembly (except for the paper parts thereof) is preferably made of plastic, injection molded, in one or two pieces, which are assembled through the use of adhesive, cold welding, etc. Alternatively, frame 12 may be made of smoked plexiglass and board 10 may be made of plywood which may be attached to frame 12 by screw fasteners or the like (not shown). The calendar may contain means (not indicated) for attaching it to a wall or other vertical surface or may contain additional stabilizing means (not shown) for standing it securely on a horizontal surface, such as a desk.

OPERATION

Figure 2:
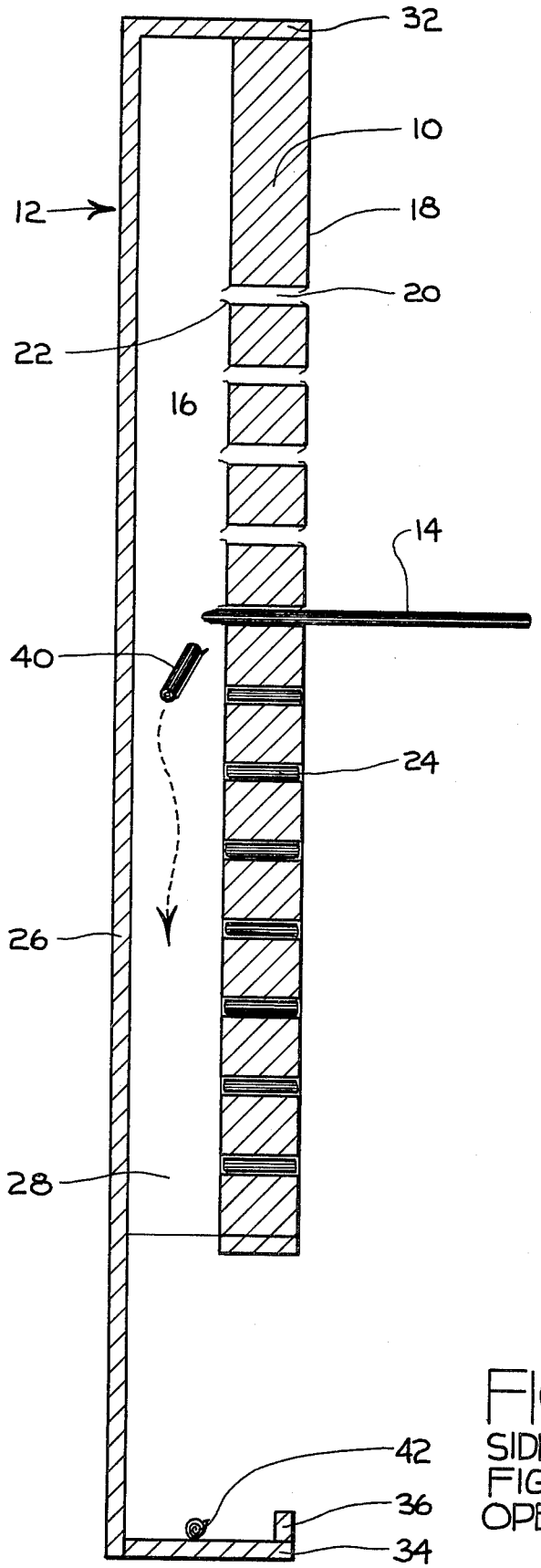
FIG. 2 is a side sectional view of the calendar of FIG. 1 taken along the lines 2—2 and actually showing the calendar in use.

In operation, as each day occurs, a user of the calendar would use pusher 14 (or other suitable elongated device) to push out the paper roll for that day, in the manner indicated in FIG. 2. To this end, each section of the face of front paper overlay 18 has a dot or other target 38 showing where pressure from pusher 18 is to be applied to push out the paper roll, as in a conventional punchboard arrangemennt. Upon use of pusher 14, as indicated in FIG. 2, the paper roll in the appropriate section would be forced through the paper or tissue back overlay 22 and into chute 16 behind board 10, as indicated at 40, where it falls down chute 16 and lands on member 34 of the trough at the bottom of the calendar. Thereupon, as indicated at 42, it may be easily retrieved by the user of the calender. The paper roll would then be unrolled and read by such user. The paper rolls may be glued or taped lightly, or they may merely be rolled without any form of adhesive, so that they are held in the rolled state by the captivation provided by their respective holes in board 10.

As indicated in FIG. 1, the elasped days of the year up to May 9, from which the respective paper rolls have already been punched out, provide relatively large, easy-to-see indicia, while the unpunched days (May 10 onward) have merely a small dot or target such as 38 and are greatly different in appearance than their punched-out counterparts. Thus the calendar marks clearly and graphically the elapsed and current day of the year and distinguishes these days from future days which have yet to be punched.

The calendar may be sold as a unit, with a new assembly with a full "load" of paper rolls already assembled into it, or alternatively frame 12 may be a permanent portion, retained by the user and a new board 10 with an imprinted front overlay, a load of paper rolls, and a rear paper overlay may be sold each year to replace the previous year's board.

As a third, and more economical alternative, a kit consisting of a load of 365 paper rolls and front and rear prepasted or adhesive paper overlays may be sold so that the user may assemble the paper rolls into the calendar and attach the front and rear overlays to both sides of board 10. However this alternative is not preferred since some precision would be required to align the target dots with the holes in board 10.

While the above description contains many specificities, these should not be construed as limiting, but rather as an exemplification of several preferred embodiments of the invention. Various other embodiments and ramifications are possible. For example the calendar, instead of being a mechanical device as indicated, may be made in all-electronic form, with the messages stored in computer memory, the punch-out operations being done by keyboard entries or the use of a light pen on a CRT, the display being provided on a CRT or on a matrix-type keyboard, etc. Also, the calendar may have a provision for displaying the pushed-out paper rolls; in this case each paper roll would have an adhesive backing and could be adhered to its respective section of the calender after being read, so that all the messages from the elapsed and current day of the year could be displayed graphically and simultaneously on the elapsed and current day of the year. In this case the size of the paper rolls would conform to the size of the respective day sections of the calendar and a border area would be imprinted on each day's section to guide the user as to the precise location to paste that day's respective paper roll. Accordingly the full and true scope of the invention should be determined only by the appended claims and their legal equivalents.

I claim:

1. A punchboard calendar for clearly demarking the elapsed days of the year and for concurrently providing daily amusement, inspiration, or information, said calendar comprising:

a rigid board having front and rear parallel major surfaces, said front and rear surfaces being spaced apart, said board having an array of spaced holes therethrough, each hole extending from said front surface thereof through to said rear surface thereof, each hole containing a compacted web having a message thereon, said message being unreadable by reason of the compaction of said web, but being readable upon the removal of said web from said hole and the opening thereof to an uncompacted state, said front and rear surfaces of said board being covered by respective tearable front and rear overlays which retain said compacted message webs from exiting said holes via said front or rear surfaces of said board, said front overlay containing indicia thereon which divide said front web, and hence said front side of said board, into an array of sections, each section overlying a respective one of said holes, each section having indicia designating a respective portion of the overall time period covered by said calendar and a respective underlying hole, and means for punching out any of said message webs from said front side of said board, said board being mounted upon an assembly which includes a passageway behind said board and a tray under said board, whereby any message web can be removed with said punching-out means by punching through said front overlay to said compacted message web and continuing to push until said compacted message web is pushed out the rear side of said board through said rear overlay, whereby said message web will fall down said passageway to said tray, thereby to leave a punched-out portion of said front overlay and an empty hole in said board so as to mark clearly any section of said board from which a message web has been removed, thus enabling elapsed portions of said overall time period to be readily apparent upon viewing said calendar and enabling users of said calendar to concurrently receive a new message each day upon use of said calendar.

2. A punchboard calendar for clearly demarking the elapsed days of the year and for concurrently providing daily amusement, inspiration, or information, said calendar comprising:

a rigid board having front and rear parallel major surfaces, said front and rear surfaces being spaced apart, said board having an array of spaced holes therethrough, each hole extending from said front surface thereof through to said rear surface thereof, each hole containing a compacted web having a message thereon, said message being unreadable by reason of the compaction of said web, but being readable upon the removal of said web from said hole and the opening thereof to an uncompacted state, said front and rear surfaces of said board being covered by respective tearable front and rear overlays which retain said compacted message webs from exiting said holes via said front or rear surfaces of said board, said front overlay containing indicia thereon which divide said front overlay, and hence said front side of said board, into an array of sections, each section overlying a respective one of said holes, each section bearing indicia designating a respective day of the year and also designating its respective underlying hole, the overall array of sections designating a year, and means for punching out any of said message webs from said front side of said board, whereby any message web can be removed with said punching-out means by punching through said front overlay to said compacted message web and continuing to push until said compacted message web is pushed out the rear side of said board through said rear overlay, thereby to leave a punched-out portion of said front overlay and an empty hole in said board so as to mark clearly any section of said board from which a message web has been removed, thus enabling elapsed portions of said overall time period to be readily apparent upon viewing said calender and enabling users of said calendar to concurrently receive a new message each day upon use of said calendar.

3. The punchboard calendar of claim 2 wherein said message webs are each coiled to form a cylindrical plug in each of said holes.

4. The punchboard calendar of claim 2 wherein said indicia on said front overlay divide said front overlay into an array of rectangular sections, each section having calendar indicia therein.

5. The punchboard calendar of claim 2 wherein said front overlay indicia divide said front overlay into a number of rectangular sections, each rectangular section containing means for indicating the position of its respective underlaying hole and separate means for indicating the date represented by said rectangle.

* * * * *